US006688882B1

(12) United States Patent
Williams

(10) Patent No.: US 6,688,882 B1
(45) Date of Patent: Feb. 10, 2004

(54) GAS BURNER WITH SPACED ORIFICE

(75) Inventor: Rafé Tierra Williams, Raleigh, NC (US)

(73) Assignee: Middleby-Marshall, Inc., Elgin, IL (US)

( * ) Notice: Subject to any disclaimer, the term of this patent is extended or adjusted under 35 U.S.C. 154(b) by 0 days.

(21) Appl. No.: 10/327,849

(22) Filed: Dec. 23, 2002

(51) Int. Cl.[7] ..... F23D 14/62

(52) U.S. Cl. ..... 431/354; 126/39 R; 126/39 E; 239/416.3; 431/351

(58) Field of Search ..... 431/354, 350, 431/268, 266, 351; 239/553.3, 567, 416.3, 552, 568, 554; 126/39 R, 39 E, 39 N, 39 K

(56) References Cited

U.S. PATENT DOCUMENTS 3,063,494 A * 11/1962 Meyer ..... 239/416.3
3,627,462 A * 12/1971 Lotter ..... 431/284
6,079,402 A 6/2000 Gort et al.
6,244,263 B1 6/2001 Schlosser et al.

FOREIGN PATENT DOCUMENTS

DE 3118011 A1 * 11/1982 ..... 126/39 R

* cited by examiner

*Primary Examiner*—James C. Yeung
(74) *Attorney, Agent, or Firm*—Coats & Bennett, P.L.L.C.

(57) ABSTRACT

A gas burner forces a premixing of the incoming gas with ambient air by moving the front face of the gas orifice upstream from the normal location and spacing it from the front face of the venturi portion of the burner. The premix air is pulled through the gap formed thereby and enters the venturi section with the gas via a central opening. Primary mixing air flows through separate opening(s). Both the gas and the premix air flow through the central opening, and the premix air at least partially combines with the gas before the primary air combines with the gas in the venturi. The combination of the gas, the premix air, and the primary air the routed to the output ports for combustion. Such a burner combusts the gas with an efficiency factor of at least forty-five, and optionally at a rate of at least 30,000 Btu/hr.

22 Claims, 4 Drawing Sheets

GAS BURNER WITH SPACED ORIFICE

BACKGROUND OF THE INVENTION

The present invention generally relates to the field of commercial cooking devices, and more particularly to gas burners for commercial cooking devices with increased performance.

A wide variety of gas burners have been used over the years in commercial cooking devices (e.g., commercial stoves, boilers, and the like). One common approach is to supply natural gas to the burner at a pressure regulated down to a pressure of 4–8 inches of water, mix the natural gas with ambient air (primary air) at an upstream portion of the burner, and then route the gas/air mixture to a plurality of downstream burner ports for combustion. For some burner designs, proper combustion also requires additional air, referred to as secondary air, to be supplied to the combustion site from a path external to the burner; other burner designs do not require this secondary air.

One important aspect of gas burners is their ability to efficiently convert the chemical potential energy of the gas into useful heat through the combustion process. It has long been known that the proper mixing of air and gas prior to the ejection of the same from the burner ports is very important in achieving good combustion. If not enough/too much air is provided, then the combustion process is less efficient, resulting in wasted energy and/or increased cooking times. However, the control of the mixing process is viewed in the art as being rather unpredictable, particularly in the wide variety of circumstances encountered in real world installations. Typically, a single venturi is used to mix the primary air with the incoming gas. Frequently, a mechanism is provided just upstream of the venturi to allow the operator to manually adjust the airflow for optimum combustion, such as by providing a variable shutter arrangement at the ambient air inlet. However, this has proved less than ideal in practice, given the myriad of other items vying for the operator's attention in the real world. In addition, such single venturi burners are typically limited as to their maximum heat output. Another approach is supply the burner with a preset mixture of air/gas from a canister, rather than relying on on-location mixing with ambient air. However, reliance on premix canisters is both cumbersome and frequently cost prohibitive.

Therefore, there remains a need for alternative burner designs, particularly alternative burner designs that are efficient and/or are able to produce more useful heat from a readily available gas supply.

SUMMARY OF THE INVENTION

The present invention is directed to an improved gas burner design and a method of operating the same. The burner of the present invention utilizes a unique approach for combining the gas and ambient air on-site to produce a more efficient and/or more productive combustion process. To do so, the present invention forces a premixing of the incoming gas with ambient air by moving the front face of the gas orifice upstream from the normal location and spacing it from the front face of the venturi portion of the burner. The air used for the premixing is pulled through this gap and enters the venturi section with the gas. Additional ambient air, the primary air, flows into the venturi via separate openings spaced from the gas/premix air opening, and then combines therewith in the venturi.

In one embodiment, the burner has a main burner body with a plurality of output ports towards one end and an opposing input end, with the venturi therebetween. A central opening is disposed on the upstream side of the venturi. The gas orifice outputs gas at a front face disposed upstream and spaced from this central opening. In addition, other opening (s), called the primary opening(s), are disposed on the upstream side of the venturi and spaced from the central opening. The primary mixing air flows through these primary opening(s) and combines with the gas in the venturi. Both the gas and the premix air flow through the central opening and the premix air at least partially combines with the gas before the primary air combines with the gas. The combination of the gas, the premix air, and the primary air the routed to the output ports for combustion. The central opening and the primary openings may advantageously be provided by a restricting plate rotatably moveable with respect to the input end. A mounting bracket may be connected to the restricting plate to support the gas orifice body in spaced relation to the central opening. Such a burner combusts the gas with an efficiency factor of at least 45, and optionally at a rate of ≧30,000 Btu/hr. In some embodiments, the burner combusts the gas at a rate of approximately 40,000 Btu/hr with an efficiency factor of at least 50.

DETAILED DESCRIPTION OF EMBODIMENT (S) OF THE INVENTION

The present invention generally relates to the field of commercial cooking devices, and more particularly to gas burners for commercial cooking devices. The present invention modifies the input to a conventional commercial burner body so that the incoming gas is subjected to a premixing with air before being subjected to the main air/gas mixing in the venturi. For simplicity, the following discussion will use a natural gas burner as an illustrative example of a gas burner for a cooking device, but it should be understood that the invention is not limited to using natural gas and may be used with propane, liquefied natural gas, and other fuels known in the commercial cooking industry.

Figure 1:
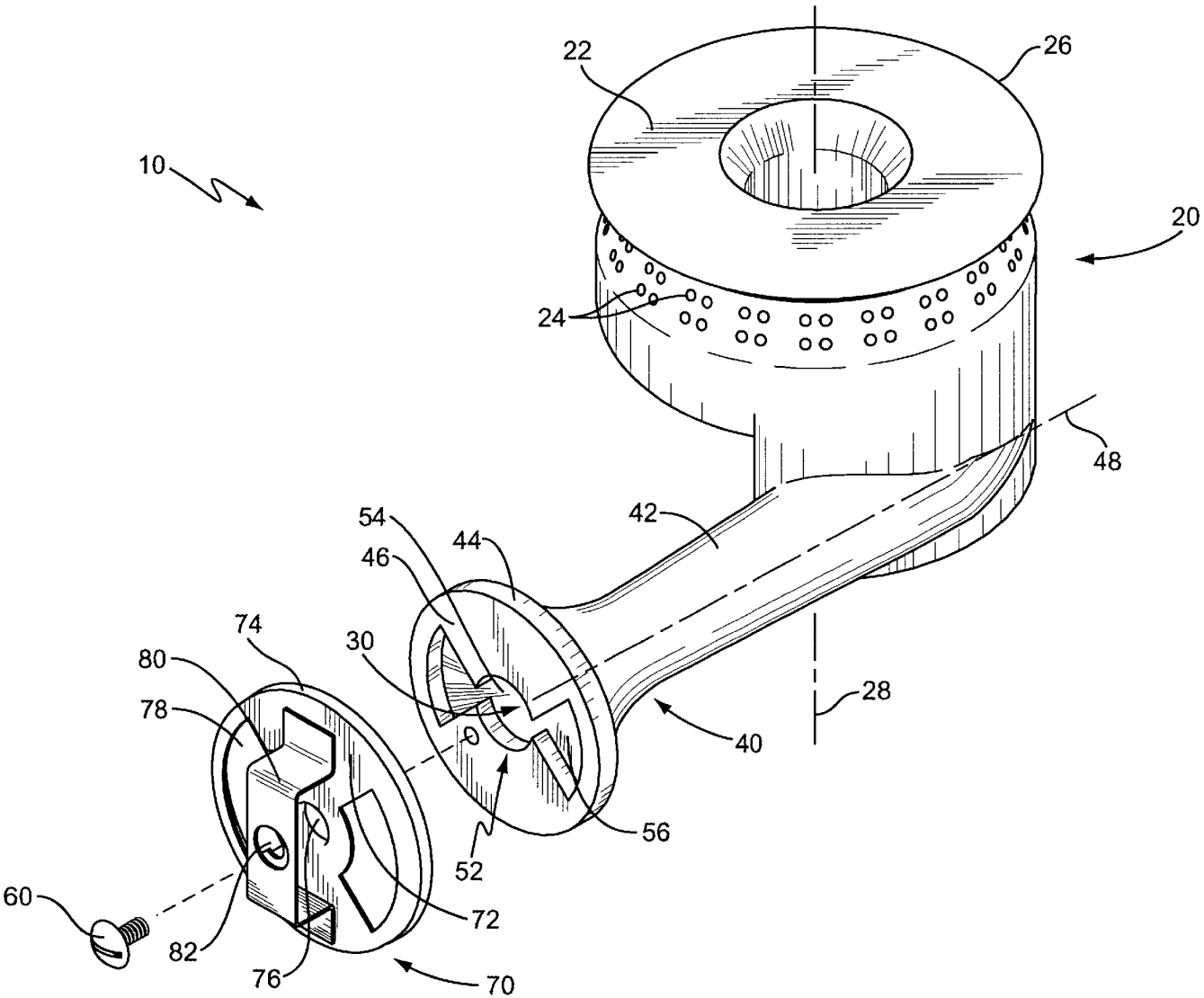
FIG. 1 shows a partially exploded perspective view of one embodiment of a burner according to the present invention with the orifice removed.
Figure 2:
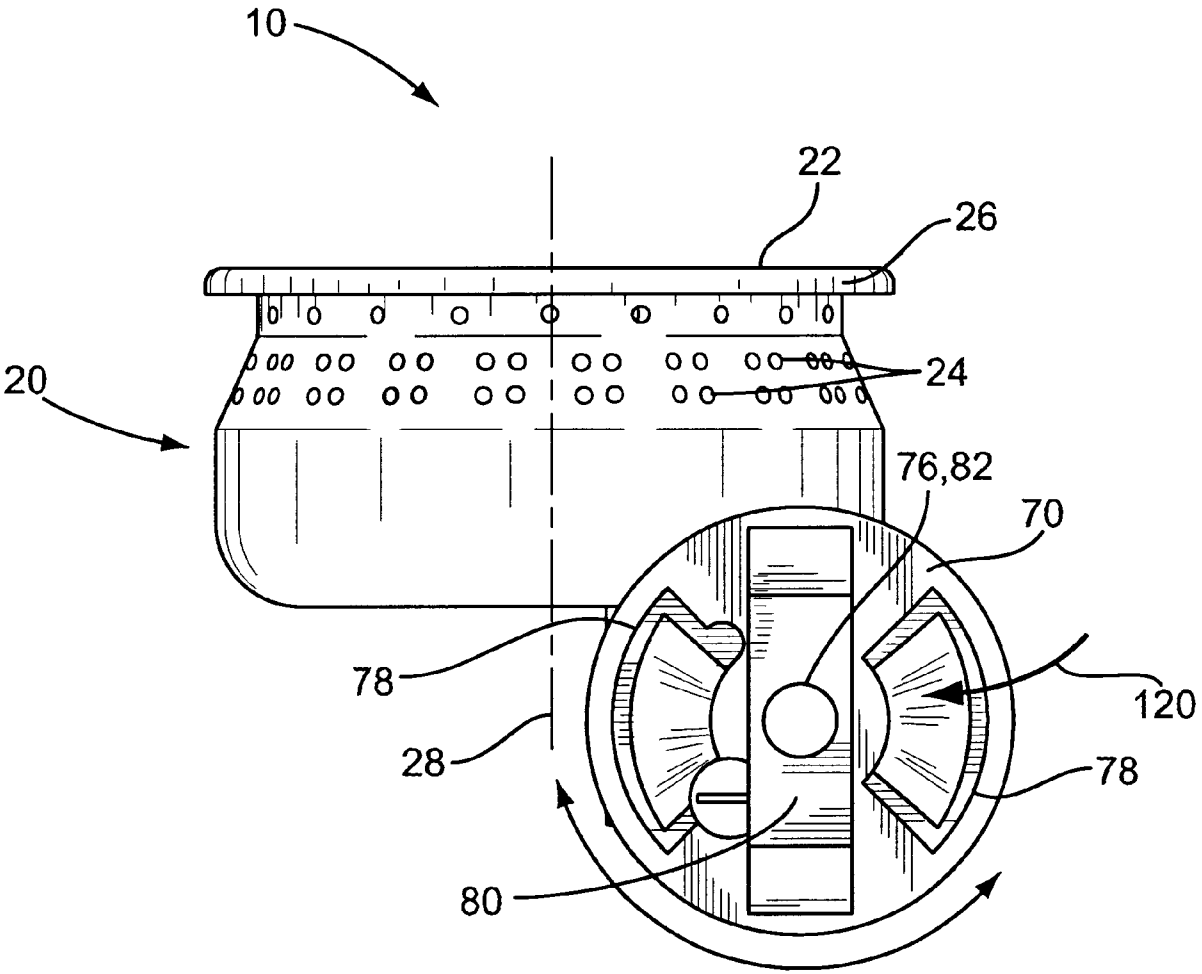
FIG. 2 shows a front face side view of the burner of FIG. 1 in an assembled condition, also with the orifice removed.
Figure 3:
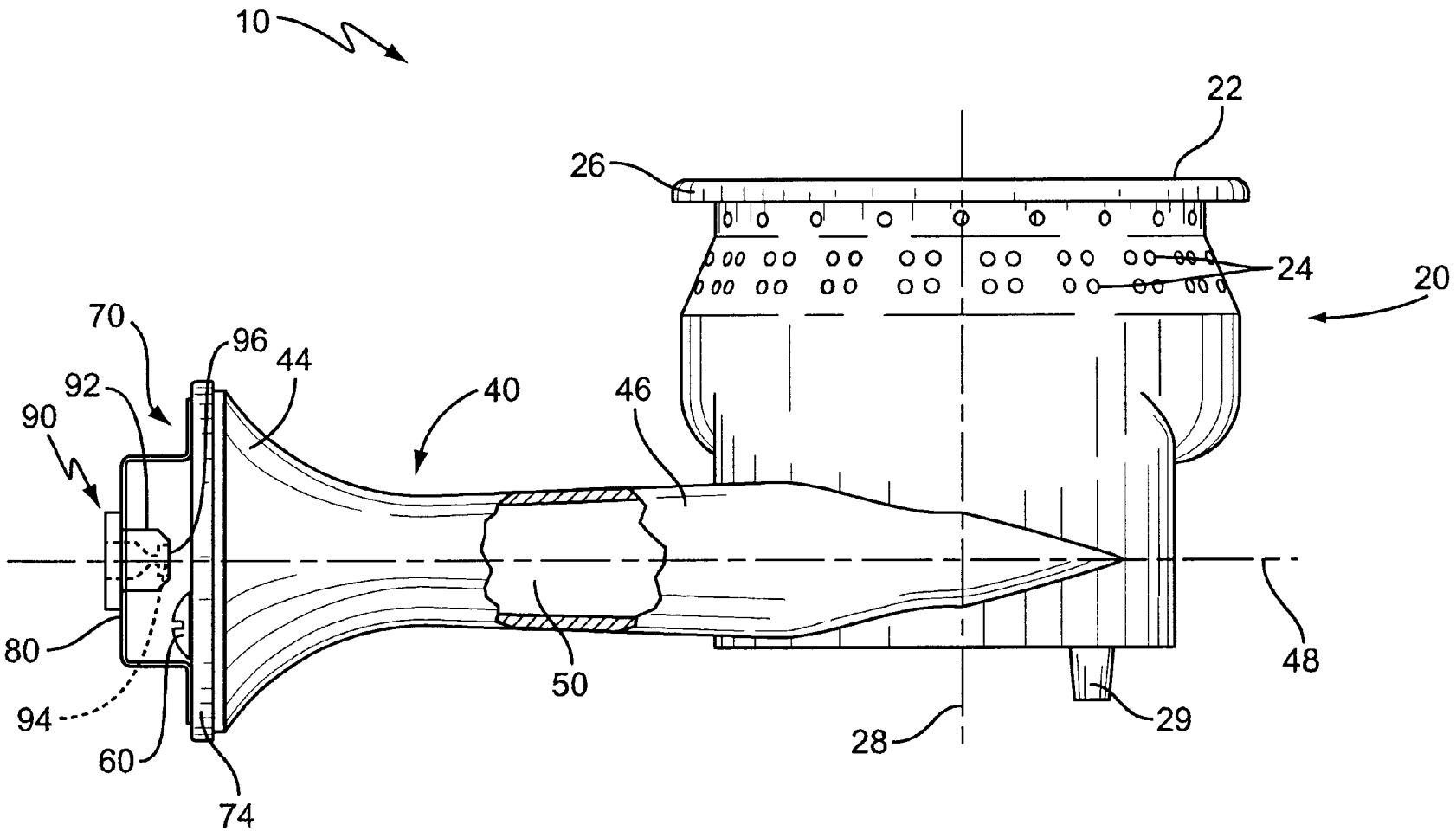
FIG. 3 shows another side view of the burner of FIG. 1 with the orifice.
Figure 4:
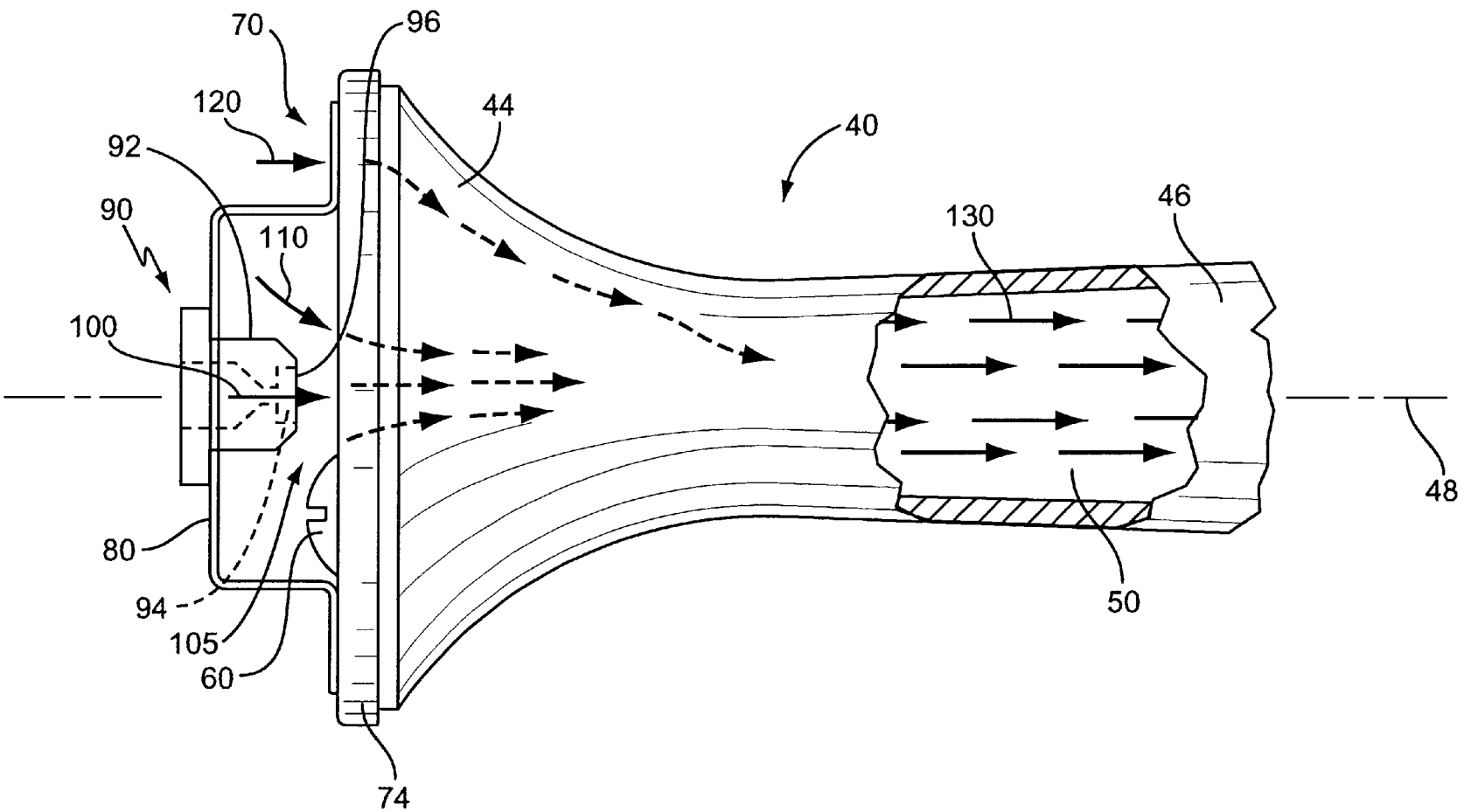
FIG. 4 is a more detailed view of a portion of the burner of FIG. 3, and shows the gas and air flow paths.

One embodiment of the burner is shown in FIGS. 1–4, and generally indicated at 10. The burner 10 includes a main body 20, a restricting plate 70, and an orifice 90. The main body 20 includes a head section 22, a venturi section 40, and an input 30. The head section 22 is a generally cylindrical body with an optionally open center area. The head section 22 is preferably symmetric about a generally vertical axis 28, with a plurality of output ports 24 disposed at various positions about the periphery of the head section 22. These output ports 24 are preferably oriented generally horizontally and are preferably regularly spaced about the periphery of the head section 22. The upper portion of the head section 22 may optionally include an overhanging flange 26 that acts to prevent drippings and other contaminants from falling into, and thereby clogging, the output ports 24. The annular body formed by the head section 22 is hollow, with the output ports 24 opening into a common inner chamber (not shown).

The venturi section 40 includes a downstream portion 42 and an upstream portion 44. The downstream portion 42 connects to the head section 22 at the lower portion thereof and extends generally horizontally away from the head section 22. The downstream portion typically takes the form of a gently expanding conical section about generally horizontal axis 48. The upstream portion 44 is supported by the downstream portion 42 and flares out from the relatively narrow diameter of the downstream portion 42 to a substantially larger diameter at the input 30 of the main body 20. Like the head section 22, the venturi 40 is hollow, with a central passage 50 in the upstream portion 44 and downstream portion 42 that operatively connects to the inner chamber of the head section 22. The face 46 of the upstream portion 44 of the venturi 40 typically forms the input 30 of the main body 20. This face 46 may include "bow-tie" shaped aperture 52 with a generally round center section 54 and two opposing arc-shaped lobes 56. In addition, the face 46 may optionally include a tapped hole for accepting a screw 60 as described further below.

The main body 20 of the burner 10 may be made from any suitable material, such as by cast iron, etc. Preferably, the head section 22 and the venturi section 40 are integrally formed. In addition, the main body 20 may optionally include a locating pin 29 if desired to aid in locating and securing the burner 10 in position within a commercial cooking device.

It should be noted that the main body 20 as described above is a known commercially available product utilized in product number 1182193, available from Southbend Company of Fuquay-Varina, N.C., rendering further discussion of the details of its configuration and operation unnecessary for understanding by one of ordinary skill in the art. While some details of the main body 20 have been described to aid in understanding the present invention, these details are not intended to be limiting unless directly claimed. The inventive approach of the present invention focuses on modifications to burner designs that employ similar combustion-related principles as used in the main body 20 described above.

For the embodiment of FIGS. 1–4, a restricting plate 70 is disposed just upstream of the main body 20 on the input end. The restricting plate 70 includes a main section 72 disposed generally parallel to the face 46 of the venturi section 40 and bordered by a flange 74 that extends perpendicular thereto. The flange 74 extends around a corresponding flat outer section of the venturi section 40 of the main body 20. The main section 72 includes a central opening 76 and two arc-shaped primary openings 78 disposed radially outward from the central opening 76 and disposed opposite each other. The central opening 76 is preferably round in shape, with a relatively sharply radiused inwardly protruding lip. The primary openings 78 are preferably sized and shaped to match the lobes 56 of the face 46 of the venturi section 40. The restricting plate 70 is rotatably secured to the main body 20 by screw 60; loosening screw 60 allows the restricting plate 70 to be rotated, while tightening screw 60 allows the restricting plate 70 to be locked in place relative to face 46. It is advantageous to size primary openings 78 and lobes 56 so that rotating the restricting plate 70 has the effect of increasing or decreasing the flow of primary air 120 to the venturi 40. Due to this shuttering action, the restricting plate 70 is sometimes referred to as a shutter in the art. The restricting plate 70 may be made from any suitable material known in the art, such as steel.

The orifice 90 includes an orifice body 92 with a central passage ending at an orifice port 94 at the front face 96 of the orifice body 92. The front face 96 may meet the periphery of the orifice body at a chamfer section. The gas supply is connected to the upstream end of the orifice body 92, and the gas flows through the orifice body 92 and out the orifice port 94. These type of orifice bodies 92, and their operation, are well known in the art.

In the prior art, the orifice 90 was mounted directly to the restricting plate 70, with the orifice body 92 extending through the central opening 76. As such, the gas ejected by the orifice 90 was injected directly into the venturi section 40 where it mixed with the primary air 120 flowing through the outer openings 78. This combined flow then was routed to the output ports 24 on the main body 20 for combustion.

In contrast, the burner of the present invention 10 has the front face 96 of the orifice 90 spaced away from the central opening 76 so that both ambient air and gas 100 enter the main body 20 through the central opening 76. One approach to spacing the front face 96 of the orifice 90 from the central opening 76 is to locate the orifice 90 upstream from the main section 72 of the restricting plate 70 via a mounting bracket 80 portion of the restricting plate 70. The mounting bracket 80 may take any suitable shape, but the simple inverted U-shape shown in the Figures is believed advantageous. Such a bracket 80 should include a support hole 82, aligned with the central opening. 76, for engaging and holding the outer surface of the orifice body 92. In such an arrangement, the front face 96 of the orifice 90 is supported in a location upstream of the central opening 76 and aligned therewith, with a gap 105 formed between the orifice body 92 and the restricting plate 70. Through the action of the gas ejection, etc. ambient air is pulled into the central opening 76 through this gap 105. Thus, both gas 100 and ambient air flow through the central opening 76. To differentiate this air flowing through the central opening 76 from the primary air 120 flowing through the primary openings 78, the air flowing through the central opening 76 will be referred to herein as the "premix air" 110. It is believed that the gas 100 mixes, or combines, at least partially with this premix air 110 before the combination is further combined with the primary air 120 in the passage 50 of venturi section 40 of the main body 20. The combined gas 100, premix air 110, and primary air 120, collectively 130, is then routed to the output ports 24 for combustion.

The burner 10 may have a venturi 40 of approximately 5½ inches long, a gap 105 of 0.125 inch, with a central opening 76 of 0.468 inch diameter, and an orifice 90 with an outer diameter of 0.438 inch, an overall length of about 7/10 inch, with an approximately 45°×¼ inch chamfer, and a port 94 of approximately 0.104 inch corresponding to a #37 drill bit. Such an orifice 90 is available from Southbend Company under part number 1008737. Of course, these dimensions of the gap 105 and the orifice are not intended to be limiting, but merely illustrative of one functional embodiment of the burner 10 of the present invention. It is believed that the gap 105 should be of a size that is approximately one-half the difference in size between the periphery of the orifice 90 and the size of the central opening 76, with a slightly smaller gap 105 for orifices with small ports 94, and a slightly larger gap 105 for orifices with larger ports 94.

The burner 10 of the present invention provides increased performance over prior art burners of the same general class (i.e., atmospheric burners, of which Bunsen type burners are a subclass). That is, preferred embodiments of the present invention are more efficient and/or are able to produce more useful heat than prior art designs. One convenient measure of the efficiency of gas burners is to compare the amount of Btu in the gas being supplied to the burner ($Btu_{in}$) to the amount of heat input to a water pot placed over the burner ($Btu_{pot}$). The value of one hundred times the ratio $Btu_{pot}/Btu_{in}$ represents the efficiency of the burner, and the term "efficiency factor" will be used herein to refer to this value. A test for efficiency can be carried out using the test method described in ANSI Z83.11 Thermal Efficiency 2.22. Prior art burners typically convert less than 40% of the Btus from the gas into useable heat at higher Btu levels (i.e., ≧⅔ of their maximum Btu output level). As such, the prior art burners have an efficiency factor of at most forty, resulting in a limited maximum production of about 26,000 Btu/hr or less of useful heat. In contrast, the burners 10 of the present invention are able to operate with an efficiency factor of at least forty-five, with an useful output of at least 30,000 Btu/hr. Indeed, some embodiments of the burner 10 are able to operate with an efficiency factor of at least sixty, with an useful output of at least 55,000 Btu/hr, but values of fifty and 40,000 Btu/hr are more typical. This increase in efficiency results in decreased fuel costs and overall energy conservation. In addition, the increase in useful output allows for faster heating, thereby reducing cooking times. As such, the burners 10 of the present invention are not only beneficial to the users thereof, but also are helpful to the nation as a whole by reducing energy usage.

The discussion above has assumed that the burner 10 includes a restricting plate 70 distinct from the main body 20; however, the restricting plate 70 may alternatively be integral to the main body 20, or omitted, although this is believed to be less advantageous. For instance, the central opening 76 and the outer opening(s) 78 may be distinct openings on the face 46 of the venturi section 40 and the mounting bracket 80 may attach directly to the main body 20. Thus, the presence of the restricting plate 70 itself is not required, provided that the front face 96 of the orifice 90 is located upstream from and spaced from the central opening 76.

The foregoing description and drawings describe and illustrate one or more embodiments of the present invention in detail. However, the present invention may be carried out in other specific ways than those set forth herein without departing from the essential characteristics of the invention. The present embodiments are, therefore, to be considered in all respects as illustrative and not restrictive, and all changes coming within the meaning and equivalency range of the appended claims are intended to be embraced therein.

What is claimed is:

1. A gas burner for a cooking device, comprising:

a main burner body having a plurality of output ports towards one end and an input end, with a venturi therebetween;

a central opening disposed upstream of said venturi and supplying at least ambient air to said venturi as premix air;

at least one primary opening disposed upstream of said venturi and spaced from said central opening, said primary opening supplying ambient air to said venturi as primary air;

an orifice outputting gas at a front face, said front face disposed upstream and spaced from said central opening;

wherein said primary air flows through said at least one primary opening and combines with said gas in said venturi;

wherein gas and premix air both flow through said central opening, said premix air at least partially combining with said gas before said primary air combines with said gas; and wherein a combination of said gas, said premix air, and said primary air is output at said output ports for combustion.

2. The burner of claim 1 wherein said main burner body includes a generally cylindrical section extending along a generally vertical axis with said output ports disposed on an outer surface of said cylindrical section and oriented generally horizontally.

3. The burner of claim 2 wherein said venturi extends along a generally horizontal axis.

4. The burner of claim 1 further comprising a restricting plate rotatably moveable with respect to said input end, said restricting plate defining said central opening and said at least one primary opening.

5. The burner of claim 1 further comprising a mounting bracket connected to said input end and supporting said orifice in spaced relation to said central opening.

6. The burner of claim 1 wherein said combination of said gas, said premix air, and said primary air combusts with the aid of secondary air supplied external to said burner.

7. The burner of claim 1 wherein said burner combusts said gas with an efficiency factor of at least 45.

8. The burner of claim 7 wherein said burner combusts said gas with an efficiency factor of at least 50.

9. The burner of claim 1 wherein said burner combusts said gas at a rate of at least 30,000 Btu/hr with an efficiency factor of at least 45.

10. The burner of claim 1 wherein said burner combusts said gas at a rate of approximately 40,000 Btu/hr with an efficiency factor of at least 45.

11. The burner of claim 1 wherein said front face of said orifice is spaced from said central opening a distance of approximately one-half the difference between a size of said orifice and a size of said central opening.

12. The burner of claim 11 wherein said orifice includes a chamfer proximate said front face.

13. The burner of claim 1 wherein said at least one primary opening is distinct and separate from said central opening.

14. The burner of claim 13 wherein said at least one primary opening comprises at least a first and a second primary opening, and wherein said first primary opening, said second primary opening, and said central opening are distinct and separate from each other.

15. The burner of claim 14 further comprising a restricting plate rotatably moveable with respect to said input end, said restricting plate defining said central opening, said first primary opening, and said second primary opening.

16. A method of generating heat for a cooking device, comprising:

providing a burner having:

a main burner body having a plurality of output ports towards one end and an input end, with a venturi therebetween;

a central opening disposed upstream of said venturi;

at least one primary opening disposed upstream of said venturi and spaced from said central opening;

an orifice having a front face disposed upstream and spaced from said central opening;

supplying ambient air to said venturi via said primary opening as primary air and combining said primary air with said gas in said venturi;

supplying ambient air to said venturi via said central opening as premix air and supplying gas to said venturi via said central opening;

at least partially combining said premix air with said gas before said primary air combines with said gas; and routing a combination of said gas, said premix air, and said primary air to said output ports for combustion.

17. The method of claim 16 wherein said main burner body includes a generally cylindrical section extending along a generally vertical axis with said output ports disposed on an outer surface of said cylindrical section and oriented generally horizontally.

18. The method of claim 16 further comprising combusting said gas with an efficiency factor of at least 45.

19. The method of claim 18 further comprising combusting said gas with an efficiency factor of at least 50.

20. The method of claim 16 further comprising combusting at a rate of at least 30,000 Btu/hr with an efficiency factor of at least 45.

21. The method of claim 20 further comprising combusting at a rate of approximately 40,000 Btu/hr with an efficiency factor of at least 45.

22. The method of claim 16 further comprising locating said front face of said orifice a distance away from said central opening, wherein said distance is approximately one-half the difference between a size of said orifice and a size of said central opening.

* * * * *